US008944079B2

(12) United States Patent
Auer et al.

(10) Patent No.: US 8,944,079 B2
(45) Date of Patent: Feb. 3, 2015

(54) DEVICE AND METHOD FOR FILLING OR PACKING CONTENTS INTO CONTAINERS

(75) Inventors: Dirk Auer, Meerbusch (DE); Sergey Anokhin, Köln (DE)

(73) Assignee: Elopak Systems AG, Glattbrugg (CH)

( * ) Notice: Subject to any disclaimer, the term of this patent is extended or adjusted under 35 U.S.C. 154(b) by 267 days.

(21) Appl. No.: 13/377,996

(22) PCT Filed: Jun. 9, 2010

(86) PCT No.: PCT/EP2010/058087

§ 371 (c)(1),
(2), (4) Date: Dec. 13, 2011

(87) PCT Pub. No.: WO2010/145978

PCT Pub. Date: Dec. 23, 2010

(65) Prior Publication Data

US 2012/0085370 A1 Apr. 12, 2012

(30) Foreign Application Priority Data

Jun. 15, 2009 (DE) ..... 10 2009 025 300

(51) Int. Cl.
*B08B 3/00* (2006.01)
*B65B 55/10* (2006.01)

(52) U.S. Cl.
CPC ..... *B65B 55/10* (2013.01); *B65B 2210/06* (2013.01)
USPC ..... 134/99.1; 134/22.1; 134/170; 134/177; 141/91; 141/92; 53/425; 53/426; 422/28

(58) Field of Classification Search
CPC ..... B65B 55/10; B65B 2210/06; B67C 7/00; B67C 7/0006; B67C 7/0026; B67C 7/0033; B67C 7/0073; B67C 7/008; B67C 7/0086; B67C 2003/228; A61L 2202/23
USPC ..... 141/85, 89, 91, 92, 129; 53/425, 426; 422/28, 292, 299; 134/23, 61, 70, 72, 134/22.1, 99.1, 171, 175
See application file for complete search history.

(56) References Cited

U.S. PATENT DOCUMENTS 2,768,487 A * 10/1956 Fauth et al. ..... 53/407
2,771,645 A * 11/1956 Martin ..... 422/304

(Continued)

FOREIGN PATENT DOCUMENTS

DE 28 06 126 8/1979
DE 33 23 710 1/1985

(Continued)

OTHER PUBLICATIONS

German Office Action dated Mar. 29, 2010 corresponding to DE 10 2009 025 300.9-27.

(Continued)

*Primary Examiner* — Timothy L Maust
(74) *Attorney, Agent, or Firm* — Lucas & Mercanti, LLP

(57) ABSTRACT

The invention relates to a device and a method for filling or packing contents, particularly beverages, food, medications, or the like, into containers. As the containers pass through the device from an inlet to an outlet side, the containers passing through the working chamber have a sterile fluid, particularly sterile air, applied thereto for preventing germ growth. In order to reduce the cleaning effort for lines for the sterile fluid, the invention proposes that a cleaning medium having an internal line is inserted into the line for applying the sterile fluid. The line no longer needs to be disassembled in order to load the sterile fluid. In order to distribute the sterile fluid uniformly throughout the containers in a working chamber, the sterile fluid is distributed in two stages, first by means of the pipe extending into the working chamber, as described above and then through a profile extending over the containers and below the pipe, having openings for passing the sterile fluid. The profiles can be disposed rotatably about an axis, in order to reduce the cleaning effort after filling.

11 Claims, 4 Drawing Sheets

(56) References Cited

U.S. PATENT DOCUMENTS

| | | | | | |
|---|---|---|---|---|---|
| 3,087,209 | A | * | 4/1963 | Monk | 422/304 |
| 3,101,730 | A | * | 8/1963 | Harris et al. | 134/167 R |
| 3,376,689 | A | | 4/1968 | Simpson et al. | |
| 4,628,972 | A | * | 12/1986 | LaRochelle | 141/91 |
| 5,022,165 | A | | 6/1991 | Beswick | |
| 5,048,549 | A | * | 9/1991 | Hethcoat | 134/122 R |
| 5,127,416 | A | * | 7/1992 | Wakabayashi et al. | 134/104.1 |
| 5,129,212 | A | * | 7/1992 | Duffey et al. | 53/426 |
| 5,520,734 | A | * | 5/1996 | Taylor et al. | 118/307 |
| 5,660,100 | A | * | 8/1997 | Spelten et al. | 99/356 |
| 5,799,464 | A | | 9/1998 | Olsson | |
| 5,979,515 | A | | 11/1999 | Olsson | |
| 5,997,827 | A | * | 12/1999 | Mezger et al. | 422/292 |
| 6,032,438 | A | * | 3/2000 | Sanfilippo et al. | 53/432 |
| 6,120,730 | A | * | 9/2000 | Palaniappan et al. | 422/28 |
| 7,111,440 | B2 | * | 9/2006 | Anderson et al. | 53/433 |
| 8,181,429 | B2 | * | 5/2012 | Iwashita et al. | 53/426 |
| 8,349,272 | B2 | * | 1/2013 | Hill | 422/304 |
| 8,591,826 | B2 | * | 11/2013 | Auer et al. | 422/300 |
| 2006/0008383 | A1 | * | 1/2006 | Moller et al. | 422/62 |
| 2009/0007522 | A1 | * | 1/2009 | Sakai et al. | 53/426 |
| 2009/0173049 | A1 | | 7/2009 | Ruzic et al. | |
| 2010/0021359 | A1 | | 1/2010 | Auer et al. | |

FOREIGN PATENT DOCUMENTS

| | | |
|---|---|---|
| DE | 10 2005 004 658 | 6/2006 |
| DE | 10 2005 047 427 | 12/2006 |
| DE | 10 2007 021397 | 11/2007 |
| EP | 0 356 011 | 2/1990 |
| EP | 0 427 348 | 5/1991 |
| EP | 0 812 177 | 12/1997 |
| JP | 11-206860 | 8/1999 |
| WO | WO 95/31375 | 11/1995 |
| WO | WO 2007/036492 | 4/2007 |

OTHER PUBLICATIONS

International Preliminary Examination Report dated Sep. 29, 2011 corresponding to PCT/EP2010/058087.

International Search Report dated Apr. 6, 2011 corresponding to PCT/EP2010/058087.

Written Opinion dated Apr. 6, 2011 corresponding to PCT/EP2010/058087.

English Translation of the International Preliminary Report of Patentability corresponding to International Application No. PCT/EP2010/058087.

* cited by examiner

DEVICE AND METHOD FOR FILLING OR PACKING CONTENTS INTO CONTAINERS

CROSS-REFERENCE TO RELATED APPLICATIONS

This is a U.S. national stage of application No. PCT/EP2010/058087 filed 10 Jun. 2010. Priority is claimed on German Application No. 10 2009 025 300.9 filed 15 Jun. 2009, the content of which is incorporated herein by reference in its entirety.

BACKGROUND OF THE INVENTION

1. Field of the Invention

The invention pertains to a device and a method for filling or packing containers with contents, especially with beverages, food products, medications, etc. While the containers travel through the device from an entrance side to an exit side, the containers passing through the working space are treated with a sterile fluid, especially sterile air, to prevent microbial contamination. The sterile atmosphere in the working space must be maintained until the process of sealing the containers has been completed inside the working space.

2. Description of the Related Art

After a large number of containers has been transported through the working space and the containers have been filled or packed, the working space is cleaned. Water, alkaline or acid-based foam products, and hydrogen peroxide ($H_2O_2$) aerosols in particular are considered suitable cleaning agents.

A device for the aseptic packing of containers with food products and other products inside a working space is known from U.S. Pat. No. 3,783,581. The packaging containers travel through it from an entrance side to an exit side. A sterile atmosphere is maintained in the working space by the use of several gas distribution pipes arranged underneath it, which feed high-temperature steam or superheated air into the working space.

From DE 10 2005 004 658 B3, it is known that sterile air can be blown into the entire working space of the filling machine to produce a clean-room atmosphere. The sterile air is supplied through at least one hose, which is installed in the area of the ceiling zone of the working space; this hose is connected to a feed for the sterile air and comprises a plurality of holes, the number, distribution, and size of which are adapted to the working space to be supplied. The hose is intended for a single use. The idea behind using the hose only once is to save the cost, which would otherwise be considerable, of cleaning the gas distribution pipes between two filling operations, after the containers have been transported through the working space.

A feed device for a cleaning medium arranged in an aseptic working space is known from EP 0 427 348 A1; to clean the aseptic working space, the device comprises two pipes extending laterally along the sides of the working space. Each pipe comprises a plurality of spray openings and can be supplied with a cleaning medium. The cleaning medium is supplied under pressure to the two spray pipes while the pipes are being rotated. The cleaning medium emerging under pressure from the spray openings forms a circular jet.

A device for sterilizing objects such as glass bottles in a closed chamber is known from U.S. Pat. No. 5,022,165 A. The glass bottles are conveyed through the device from an entrance to an exit while they are exposed to an elevated temperature. In a preheating zone, a perforated plate above the objects distributes preheated air over the glass bottles.

DE 33 23 710 A1 discloses a gas treatment device for containers being transported on a conveyor. A channel is arranged above the conveyor and follows its course. A distributor pipe comprising openings for a sterile gas is installed in the channel. The sterile gas supplied by the distributor pipe enters the containers through a porous wall arranged in the channel underneath the distributor pipe. The porous wall concentrates the sterile gas on the area of the container openings, whereas the other container parts can be exposed to the influence of surrounding air.

SUMMARY OF THE INVENTION

A first goal of the invention consists in reducing the effort required to clean the lines for a sterile fluid in a working space, through which containers are conveyed from an entrance to an exit, especially to reduce the cleaning effort required after the containers have left the working space. It should no longer be necessary to remove the multiply reusable line for the sterile fluid.

This goal is achieved by a device having a working space with a work station for executing a working step on a container passing therethrough, where an external line passes through the work space and has several openings for introducing a sterile fluid into the working space to create a sterile atmosphere, and an internal line passes through the external line with several openings for spraying a cleaning medium into the space between the internal line and the external line. The external line extending through the working space to introduce the sterile fluid, especially sterile air, is cleaned by the introduction of the cleaning medium through the internal line and by the spraying of the cleaning medium into the ring-shaped space between the internal and external lines. There is no need to remove the line so that the sterile fluid can be introduced.

The internal line extends through the external line, wherein the external line preferably surrounds the internal line over its entire length. The external line comprises several openings for the introduction of the sterile fluid; these openings are preferably distributed in the longitudinal direction and around the circumference of the line.

The effectiveness with which the external line for the introduction of the sterile fluid can be cleaned can be improved by installing the external and internal lines in such a way that they can be rotated around their longitudinal axes relative to each other. To prevent the internal line from contacting the inside wall of the external line during such rotation, both the internal and the external lines are designed as dimensionally stable pipes.

To distribute the sterile fluid, especially sterile air, uniformly over the containers in the working space, it is proposed in one embodiment of the invention that at least one profile with openings be arranged in the working space underneath the external line so that it extends over the containers. This profile distributes the sterile fluid introduced through the external line over the containers. The types of profiles which can be considered include in particular rectangular profiles and angle profiles. The height of the rectangular profiles is limited in comparison to their width. They are therefore also referred to in the following as plates. The profile is preferably designed as a perforated plate. If the perforated plate is bent along one edge, it forms an angle profile. A flat, perforated plate forms a rectangular profile.

The sterile fluid is distributed in two stages. The first stage proceeds by way of the external line, preferably designed as a pipe, which extends over working space and which has several openings for the passage of the sterile fluid. The second stage proceeds through the profile extending underneath the pipe, the profile being provided with openings for the passage of the sterile fluid. The profile is designed in particular as a plate or as an angle profile. An angle profile channels the fluid passing through the openings in the angle profile and improves the efficiency with which the fluid can be drawn away through an exhaust device installed near the floor of the working space.

So that the profile can be cleaned with a cleaning medium, especially so that it can be cleaned on all sides, without the need to remove it from the working space, each profile is installed according to an advantageous embodiment of the invention so that it can rotate around an axis, namely, an axis around which the profile can be rotated between a first position, in which containers are present in the working space, and a second position, in which no containers are present in the working space. The cleaning agent is used in the second position of the profile.

Another goal of the invention consists in reducing the amount of effort required to clean a profile with openings extending over the containers in a working space through which containers are transported from an entrance side to an exit side. The profile serves in particular to distribute sterile fluid in the working space.

This goal is achieved by a device with a working space through which containers are conveyed, with at least one profile with openings extending over the containers, each the at least one profile being designed to rotate about an axis between a first position and a second position. Types of profiles which can be considered include here again in particular rectangular profiles or angle profiles, which are preferably designed as perforated plates.

The device can be cleaned automatically by means of a feed device for a cleaning medium. The feed device acts on the profile while it is in the position which it assumes when there are no containers in the working space.

So that a sterile fluid, especially sterile air, can be distributed uniformly over the containers in the working space of the device, it is proposed according to one embodiment of the invention that at least one pipe with several openings for the introduction of a sterile fluid into the working space extend through the working space above each profile. The sterile fluid is distributed when the profile is in the position which it occupies when containers are present in the working space.

The invention pertains in particular to filling machines for filling packaging containers with liquid food products, with a working space through which the packaging containers can be conveyed from the entrance side to the exit side by means of at least one conveying means along a conveying path.

The internal line for introducing the cleaning agent is designed in particular as a spray pipe extending along the conveying path in the interior of the working space. This spray pipe can rotate around its longitudinal axis and comprises a plurality of spray openings and means for supplying the cleaning agent to the interior of the spray pipe.

Each spray pipe extends through the external line, which is designed as a gas distribution pipe for the uniform distribution of the gaseous sterile fluid to create a clean-room atmosphere in the working space, wherein the gas distribution pipe preferably surrounds the spray pipe over its entire length; the gas distribution pipe comprises a plurality of gas openings, which are distributed over its length and around its circumference; and the gas distribution pipe comprises means for supplying gaseous fluid to the ring-shaped gap between the spray pipe and the gas distribution pipe.

After the completion of the filling operation, the gas distribution pipe, which concentrically surrounds the spray pipe over its entire length, is itself also cleaned automatically during the cleaning of the working space when the cleaning medium, which emerges under pressure from the spray openings in the rotating spray pipe, first strikes the inside surface of the gas distribution pipe before escaping through the gas openings. So that the gas distribution pipe can be cleaned effectively, the spray pipe supplied with cleaning medium is preferably rotated 360 degrees at least once around its rotational axis inside the stationary gas distribution pipe; or the gas distribution pipe, which optionally can rotate independently of the spray pipe, is rotated in the opposite direction, so that the entire inside surface of the gas distribution pipe is wetted with cleaning medium.

As the packaging containers are being filled, the sterile fluid, especially the sterile air, is supplied by way of the ring-shaped gap between the internal spray pipe and the external gas distribution pipe, preferably from one end of the two concentric pipes. Because the gas openings in the gas distribution pipe are arranged, preferably uniformly arranged, not only over its entire length but also around its entire circumference, the sterile air arrives uniformly in the working space and fills its entire volume. Depending on the number of gas openings arranged on the lateral surface of the gas distribution pipe, diameters in the range of 0.1-10 millimeters have been found to be effective. The concentric pipes extend preferably all the way from the entrance side to the exit side of the working space.

The working space is preferably closed off at the top by a flat ceiling, and each gas distribution pipe is installed as close as possible to the ceiling above a filling plane defined by the edges of the open packaging containers passing through the working space. The sterile air also emerges upwards from the gas distribution pipes and therefore also strikes the ceiling; this leads to a further improvement in the distribution of the sterile air in the working space.

The processes of preheating, sterilizing, drying, and filling the packaging containers in the working space are accomplished by means of tubular feed elements, which project into the working space from the ceiling and are directed toward the open packaging containers, which are traveling along the conveying path(s). So that the gas feed pipes for the sterile air cannot interfere with the arrangement of the feed elements for the above-mentioned processes, the individual gas distribution pipes are preferably arranged next to the conveying paths or between two adjacent paths, which are parallel to each other and a certain distance apart. The distance between the paths is selected so that at least one gas distribution pipe can fit between them.

To limit the consumption of cleaning medium and to ensure the uniform distribution of the cleaning medium, especially on the inside surface of the gas distribution pipe, the spray openings are arranged on a straight or helical line extending longitudinally along the lateral surface of the spray pipe. A further improvement in the distribution of the cleaning medium is obtained by providing the spray pipe with several jet nozzles with spray openings, especially fan-type jet nozzles, wherein the edges of the jets of adjacent jet nozzles overlap each other, as a result of which the cleaning medium is sprayed without gaps.

Especially when packaging containers are being filled with liquid food products, it has been found effective to divide the filling machine into zones; starting from the entrance side, these zones consist of a preheating zone, a sterilization zone, a drying zone, a filling zone, and a sealing zone, wherein the individual zones are directly adjacent to each other and together form the aseptic working space sealed off against the atmosphere. The sterilizing action can be improved by first heating the packaging containers in the preheating zone. Then the packaging containers travel from the preheating zone to the sterilization zone, where both the outside and the inside surfaces of the packaging containers are wetted with a sterilizing agent, preferably with hydrogen peroxide ($H_2O_2$). To remove the hydrogen peroxide again after the sterilization step, the packaging containers then travel to the drying zone, where the packaging containers are rinsed with hot air. Then the packaging containers which have been pretreated in this way are filled with the liquid food product in the filling zone. Finally, the filled packaging containers arrive in the sealing zone, where the packaging containers, which have been open up to this point, are mechanically closed; this is done, for example, by folding in the top flaps, which are then heated and pressed together in the area of the package roof by sealing tools.

The separation between the individual zones is accomplished in particular by barrier walls extending transversely to the conveying path; these walls comprise openings at least for the packaging containers being conveyed by the conveying means along the conveying path and for the gas distribution pipes. In the same way, the entrance side and the exit side are sealed off against the space in which the filling machine is installed.

To avoid in particular the escape of hydrogen peroxide atmosphere from the working space into the production room surrounding the filling machine, at least one exhaust unit is assigned to the preheating zone, the sterilization zone, and the drying zone. The exhaust unit preferably comprises several exhaust pipes, which are arranged underneath the filling plane between two conveying paths or next to a conveying path; each exhaust pipe comprises a plurality of exhaust openings.

The distribution of the sterile air in the various zones of the working space can be improved by installing at least one profile with a plurality of gas pass-through openings between the at least one gas distribution pipe and the filling plane, this profile extending over the packaging containers.

The profiles, especially perforated plates, extend preferably over the entire area of the working space up the tubular feed elements. The perforated plates ensure that the sterile air is distributed uniformly over the individual zones and reaches both the inside and the outside surfaces of the open packaging containers.

If the profiles, especially the perforated plates, are able to pivot around an axis from an operating position to a cleaning position and back again, they do not have to be removed to allow the working space to be cleaned. So that the working space can be cleaned, the perforated plates are pivoted into the cleaning position, in which they do not interfere with the cleaning action of the spray pipe. The perforated plates are preferably able to pivot at least 360 degrees around their pivot axes by means of a manual or motorized drive. The ability to rotate the perforated plates all the way around during the cleaning process by means of the spray pipe ensures that the perforated plates can be cleaned completely, largely independently of how the plates are profiled.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in greater detail below on the basis of the figures.

DETAILED DESCRIPTION OF THE PREFERRED EMBODIMENTS

Figure 1:
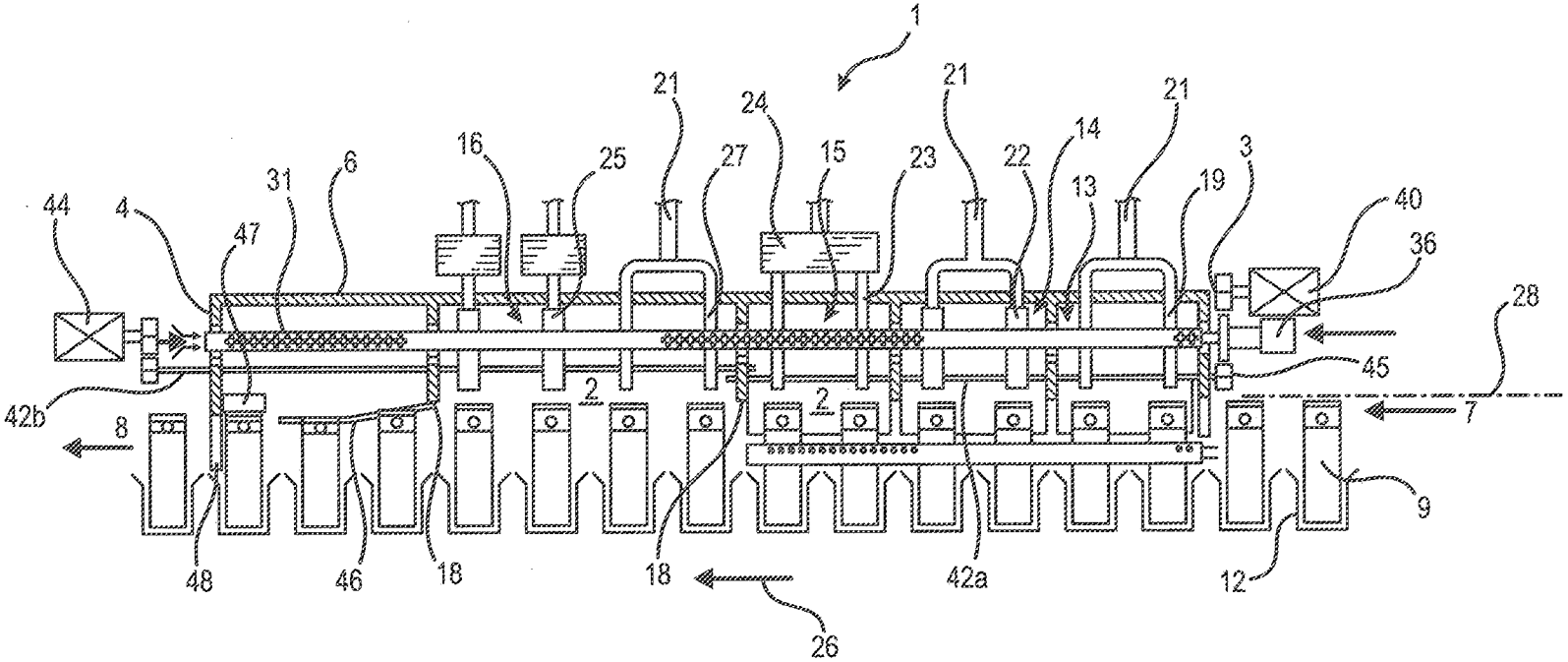
FIG. 1 shows a schematic longitudinal cross section through an inventive filling machine.

The filling machine 1 comprises a sterile working space 2, comprising the form of a hollow, rectangular block, which is bounded on the entrance side 7 by a front wall 3, on the exit side 8 by a rear wall 4, by side walls 5*a*, 5*b*, which connect the front and rear walls 3, 4 together, and by a ceiling 6 at the top. A floor (not shown in the figures) can close off the working space at the bottom. Alternatively, the side walls 5*a*, 5*b* can rest on a flat foundation, which closes off the working space at the bottom.

Figure 2:
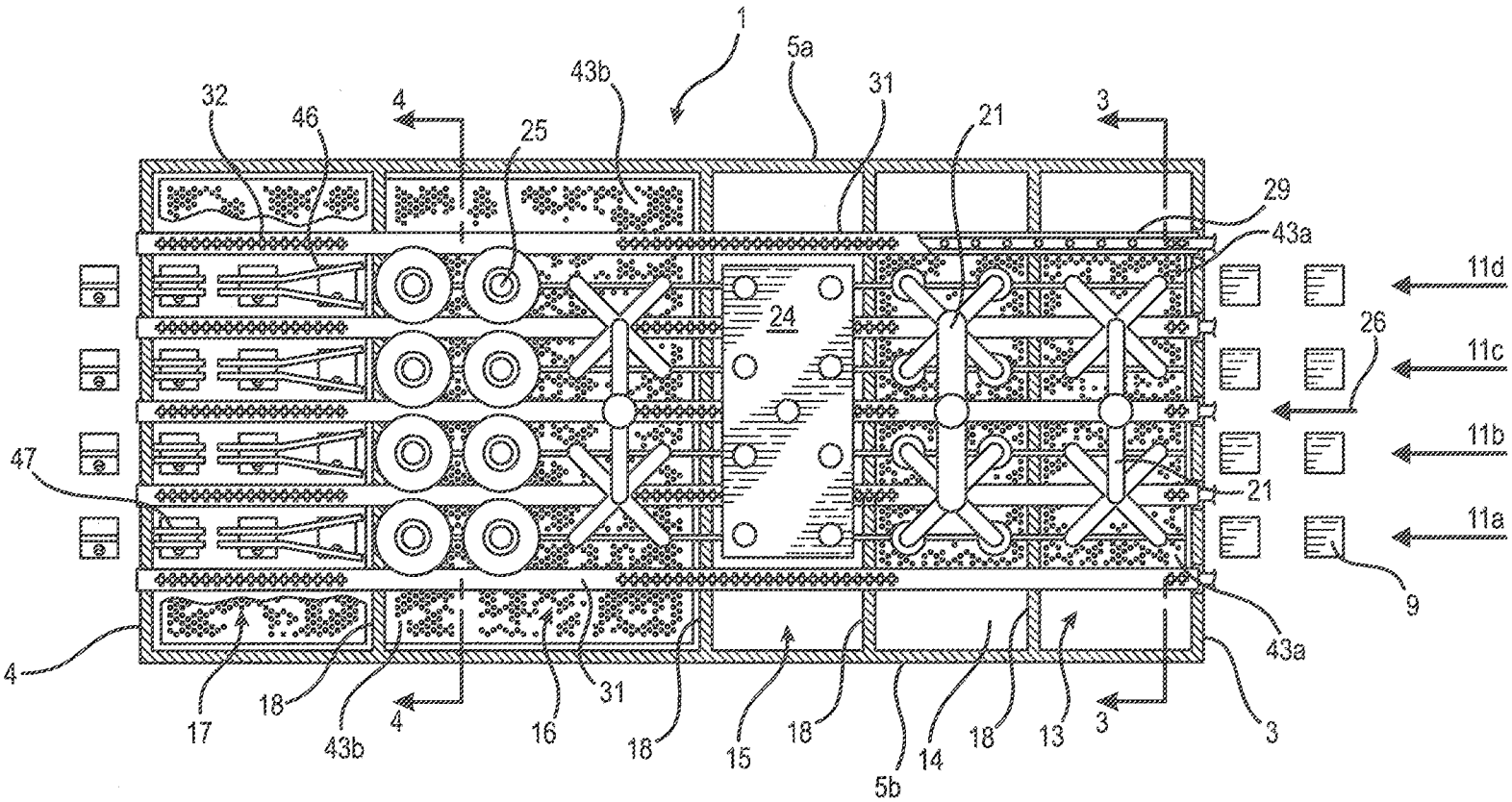
FIG. 2 shows a schematic top view of a filling machine according to FIG. 1 with the ceiling removed.
Figure 3:
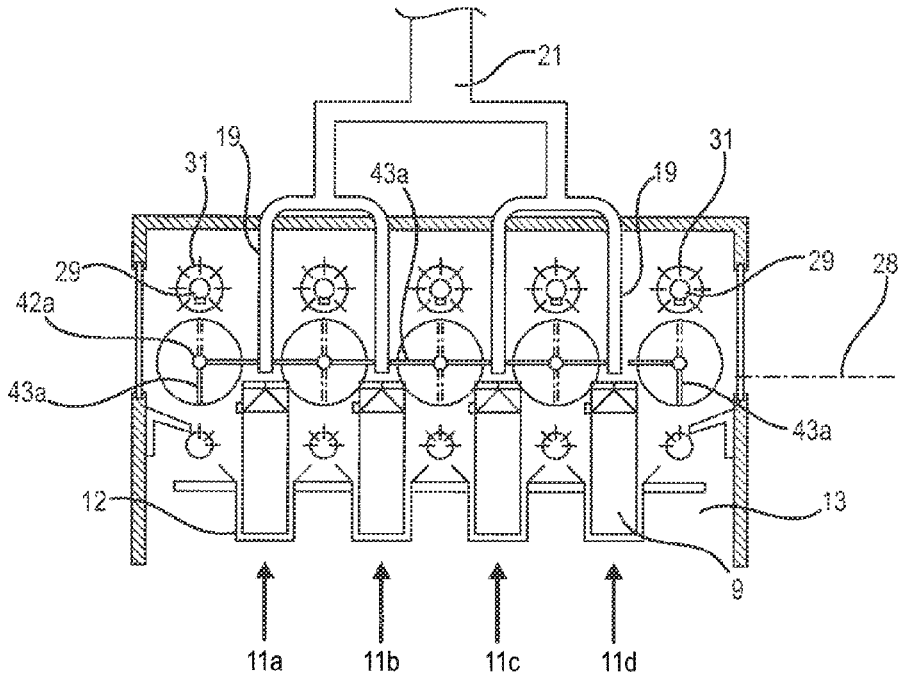
FIG. 3 shows a cross section through the filling machine along line 3-3 in FIG. 2.

Packaging containers 9 designed to hold beverages are conveyed from the entrance side 7 to the exit side 8 of the filling machine 1 along four parallel conveying paths 11*a-d* by means of an endless conveyor. Upwardly expanding, pocket-like holders 12 for the packaging containers 9 are mounted on the conveyor. FIGS. 1, 2, and 3 show only the upper strand of the endless conveyor; for the sake of simplicity, the reversal points at the two ends and the lower strand are not included in the diagrams.

Proceeding from the entrance side 7, the filling machine 1 is divided along the length of the parallel conveying paths 11*a-d* into a preheating zone 13, a sterilization zone 14, a drying zone 15, a filling zone 16, and a sealing zone 17. The various zones 13-17 are separated from each other by barrier walls 18.

Eight tubular feed elements 19 for hot air, which are aimed at the open packaging containers 9, project into the preheating zone 13. At the opposite end, the feed elements 19 come together in a distributor 21 above the ceiling 6.

Eight tubular feed elements 22 for hydrogen peroxide, which are aimed at the open packaging containers 9, project into the sterilization zone 14. At the opposite end, the feed elements 22 come together in a distributor 21 above the ceiling 6.

Eight tubular feed elements 23 for hot air, which are aimed at the open packaging containers 9, project into the adjacent drying zone 15. At the opposite end, the feed elements 23 come together in a rectangular distributor 24 above the ceiling 6.

In the filling zone 16, finally, there are eight feed elements 25 for filling the packaging containers 9 with the beverage. As also in the preheating zone 13, the sterilization zone 14, and the drying zone 15, eight open packaging containers 9 can be treated simultaneously with hot air or hydrogen peroxide or filled with the beverage by the feed elements 19, 22, 23, 25 per timing unit of the conveying means.

Optionally, additional feed elements 27 for a process gas such as nitrogen dioxide ($NO_2$) to prevent oxidation can be provided upstream, with respect to the conveying direction 26, of the feed elements 25. Such process gases are used in particular during the packaging of beverages such as fruit juices, which are sensitive to oxidation. The outlets of all the feed elements 19, 23, 25, 27 terminate just above the open packaging containers 9, the upward-facing edges of which define a filling plane 28.

Five gas distribution pipes 31 are arranged just under the ceiling 6, concentric to the longitudinal axes of five spray pipes 29. As can be seen in the top view of FIG. 2, the five gas distribution pipes 31 and the spray pipes 29 extend through the entire working space 2 from the front wall 3 all the way to the rear wall 4, wherein all of the gas distribution pipes 31 and thus also all of the spray pipes 29 are arranged above the filling plane 28. In a vertical projection, each of the three middle gas distribution pipes 31, together with the spray pipe 29 inside, is located between two conveying paths 11*a-d*, whereas the two outer gas distribution pipes 31 and the spray pipes 29 surrounded by them are located, when seen in the conveying direction 26, to the left and to the right of the associated conveying path 11*a*, 11*d*.

Each gas distribution pipe 31 has a plurality of gas openings 32, which are distributed uniformly over its entire length and also uniformly around its circumference. On a line parallel to the longitudinal axis of the gas distribution pipe 31, gas openings 33 are present which are larger than the other gas openings 32.

On a line parallel to the longitudinal axis of each spray pipe 29, several fan jet nozzles 35 with spray openings 34 are arranged on the lateral surface 39 of the pipe. The size and contour of the spray openings 34 agree approximately with the size and contour of the larger gas openings 33 in the gas distribution pipe 31.

On the entrance side 7, the five gas distribution pipes 31 are connected to the rotary pass-throughs of a distributor pipe 36, which extends transversely across the width of the front wall 3; through these pass-throughs, the sterile air is supplied to the ring-shaped gap 37 between the lateral surface 39 of each spray pipe 29 and the inside surface 38. On the entrance side 7, each spray pipe 29 is sealed off at its end. On the opposite exit side 8, furthermore, the spray pipes 31 are connected to the rotary pass-throughs (not shown) of connecting fittings, through which the cleaning medium is supplied to the interior of the spray pipes 29.

The gas distribution pipes 31 and the spray pipes 29 are able to rotate independently of each other around their longitudinal axes by means of drives 40, installed at one end outside the working space 2. The drive for only one gas distribution pipe is shown in FIG. 1.

Between the five gas distribution pipes 31 and the filling plane 28, perforated plates 43*a, b* are mounted on a total of ten driven shafts 42*a, b*. These plates can be rotated out of the operating positions shown by solid lines in FIGS. 3 and 4 into the cleaning positions shown as dash-dot lines and vice versa.

The motors 44 which drive the shafts 42*b* of the flat perforated plates 43*b* in the sealing and filling zones 16, 17 are mounted on the rear wall 4 of the working space 2. The motors 45 which drive the shafts 42*a* of the angled perforated plates 43*a* in the preheating zone 13, the sterilization zone 14, and the drying zone 15 are mounted on the front wall 3 of the working space 2.

As can be seen in the diagram of FIG. 3, the angled perforated plates 43*a* form, when in their operating position, a channel, which extends along each conveying path 11*a-d* in the preheating zone 13, the sterilization zone 14, and the drying zone 15 and which extends around the tops of the packaging containers. The channeling effect has the result that in particular the hot air and the hydrogen peroxide supplied by the feed elements 19, 22, 23 make vigorous contact with the inside and outside surfaces of the packaging containers. At the same time, through the holes in the surfaces of the perforated plates 43*a*, which are horizontal when in the operating position, the sterile air is optimally distributed in the filling plane 28 located underneath the perforated plates 43*a*.

The channeling effect is no longer necessary while the packaging containers 9 are being filled with the beverage and then sealed, for which reason the perforated plates 43*b* are not angled in the filling zone 16 or in the sealing zone 17 but are made flat instead. The whole-area coverage by the perforated plates 43*b* in these zones has the result of optimally distributing the sterile air supplied through the gas distribution pipes 31 in the filling plane 28 located underneath the perforated plates 43*b*.

The rotational axes of the shafts 42*a*, 42*b* are located in the same vertical planes as those of the gas distribution pipes 31 and spray pipes 29. The rotational axes of the shafts 42*a*, 42*b* are thus located also either between two conveying paths 11*a-d* or to the left or right of the associated conveying path 11*a*, 11*d*.

Figure 4:
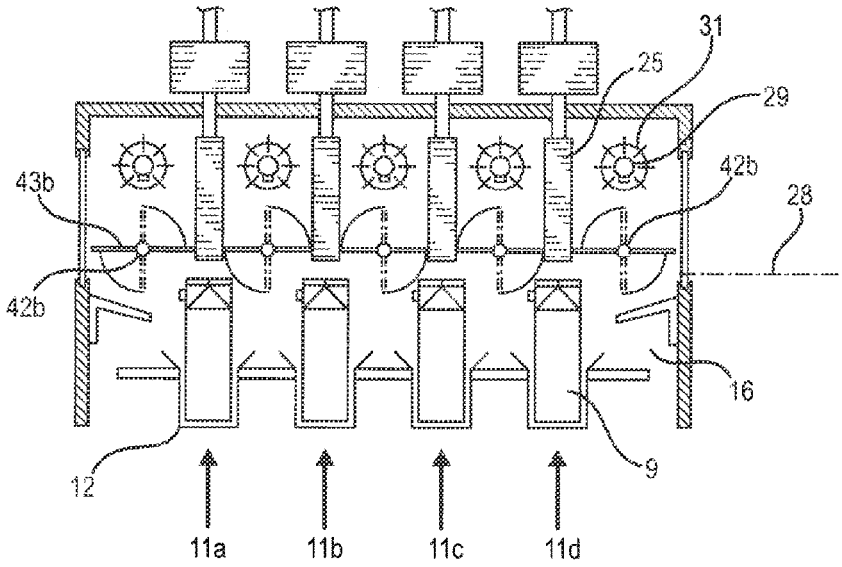
FIG. 4 shows a cross section through the filling machine along line 4-4 in FIG. 2.

As can be seen especially clearly in the diagrams of FIGS. 3 and 4, the perforated plates 43*a*, 43*b* extend over the entire working space 2, covering the entire area, and their edges reach all the way to the feed elements 19, 22, 23, 24, 27; when in their operating position, the perforated plates 43*a*, 43*b* therefore almost completely cover the packing containers (9), which are open at the top.

The way in which the inventive filling machine operates during the filling of containers with beverages and during the following cleaning process with a cleaning medium will be described in the following.

So that the packaging containers 9, which are open at the top, can be filled with liquid food products, the containers are placed in automated fashion into the pocket-like holders 12 at the entrance side 7. Each of the four endless conveyors, on which the pocket-like holders 12 are mounted, conveys eight packaging containers 9 simultaneously into the preheating zone 13 first, in which all of the packaging containers 9 are treated simultaneously with the hot air supplied through the feed elements 19. For this purpose, a cycle time of approximately 2.6 seconds is available, this also being true for each of the other steps of the process in the various zones 13-17. Approximately 0.8 second of this time is required to convey the eight packaging containers 9 onward to the zone coming next in the conveying direction 26.

Then the eight packaging containers 9, thus heated with hot air, advance to the sterilization zone 14, where they are treated with hydrogen peroxide through the feed elements 22. In the next step of the process, the eight sterilized packaging containers are sent to the drying zone 15, where the hydrogen peroxide is dried off with hot air. The sterilized packaging containers 9 now advance to the filling zone 16, where they are filled with beverages simultaneously through eight feed elements 25, before the top flaps, which are oriented parallel to the conveying direction 26, are mechanically closed by guide profiles 46 in the following sealing zone 17 and then heated and pressed together by sealing tools 47. Finally, the now sealed packaging containers 9 leave the working space 2 at the rear wall 4 through the pass-through openings 48 adapted to the contour of the packaging containers.

Figure 5:
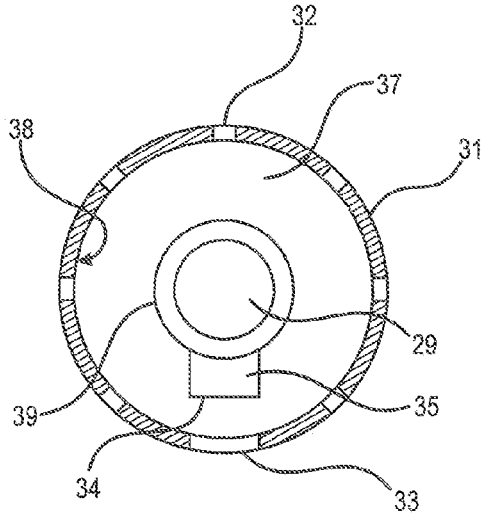
FIGS. 5-7 show cross sections through a gas distribution pipe, arranged concentrically with respect to a spray pipe, of an inventive filling machine in various operating positions.

So that a clean-room atmosphere can be maintained in the working space 2 until the packaging containers 9 have been sealed in the sealing zone 17, sterile air, which flows out into the working space 2 through the gas openings 32, 33, is supplied continuously through the gas distribution pipes 31. The gas distribution pipes 31 are located in the position indicated in FIG. 5. The larger gas openings 33 point downward toward the perforated plates 43*a, b*, which are in their working position, so that the sterile air is conducted from above to the area underneath and to the packaging containers 9 with an almost completely laminar flow.

Figure 6:
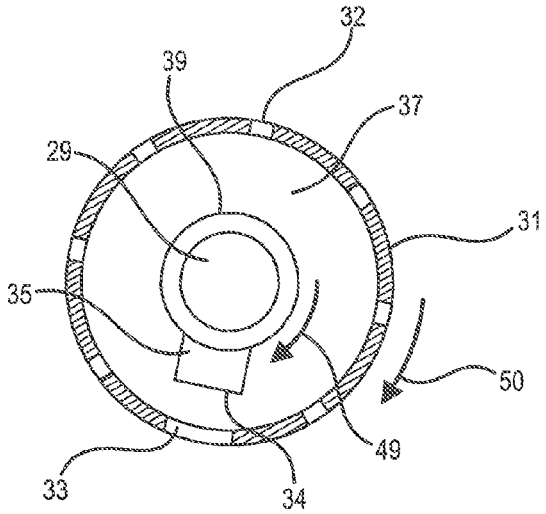
Figure 7:
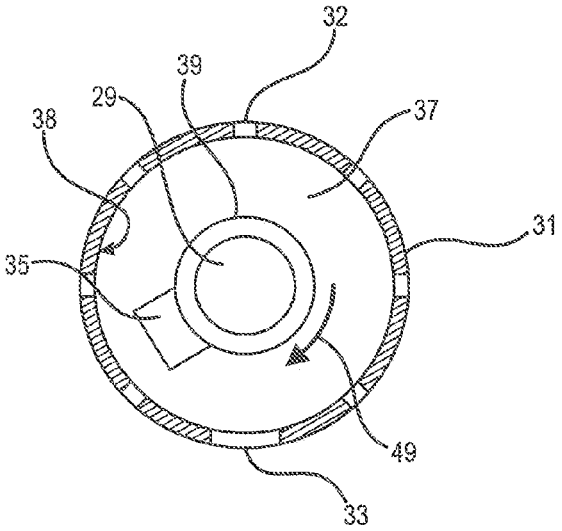

After the packaging containers 9 have been filled, the filling machine 1 must be cleaned completely before the next filling operation. For this purpose, the spray pipe 29 is supplied with cleaning medium, which emerges through the fan jet nozzles 35 arranged in a straight line. So that the entire interior of the working space 2 can be cleaned, each spray pipe 29 rotates around its longitudinal axis in the direction of the arrow 49, shown in FIGS. 6 and 7. The larger gas openings 33 in the gas distribution pipes 31 are aligned with the spray openings 34 of the fan jet nozzles of the spray pipe 29 to ensure the unhindered outflow of the fan jets during the cleaning operation. The drive of each gas distribution pipe 31 rotates the pipe synchronously with the spray pipe 29 in the direction of the arrow 50, so that the spray openings 34 remain aligned with the larger gas openings 33 during the entire cleaning operation. Finally, as shown in FIG. 7, the drive of each gas distribution pipe 31 is stopped and/or its rotational direction reversed to ensure that the cleaning medium emerging from the spray openings 34 is distributed over the entire inside surface 38 of each gas distribution pipe 31.

So that the areas underneath the perforated plates 43*a, b* can also be cleaned effectively during the cleaning of the working space 2, the plates are pivoted into the position shown in dash-dot line in FIGS. 3 and 4 during the cleaning process. So that the perforated plates 43*a*, 43*b* themselves can also be cleaned effectively on all sides, these plates are pivoted 360 degrees at least once, preferably several times, so that all surfaces of the perforated plates are exposed at least once directly to the fan jets emerging from the fan jet nozzles 35.

Water and various acid or alkaline foam products can be supplied as a cleaning medium through the spray pipe 29, and, for sterilization, a hydrogen peroxide aerosol can be supplied. The cleaning media mentioned above can be applied sequentially by means of the spray pipes 29 to clean the working space 2.

The description provided above makes it clear that the inventive filling machine makes it possible to clean automatically not only the gas distribution pipes 31 but also any perforated plates 43*a*, 43*b* which may be present, i.e., plates which can pivot around an axis. At the same time, a space-saving position, optimal for the cleaning process, is proposed for the spray pipes 29 and the gas distribution pipes 31 necessary for maintaining a clean-room atmosphere during the filling operation.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A device with a working space through which containers are conveyed from an entrance side to an exit side, comprising:

at least one station in said working space to execute a work step on the containers;

an external line passing through the working space, the external line configured for connection to a sterile fluid supply and the external line having several openings into the working space for the introduction of a sterile fluid from the sterile fluid supply into the working space to create a sterile atmosphere in the working space; and an internal line passing through the external line, the internal line being configured for connection to a cleaning medium supply that is different from the sterile fluid supply, and the internal line having several openings for spraying a cleaning medium from the cleaning medium supply into a space that extends longitudinally between the internal line and the external line.

2. The device according to claim 1, wherein the external and internal lines are pipes and are arranged so that the external and internal lines are rotatable around their longitudinal axes relative to each other.

3. The device according to claim 1, further comprising at least one profile provided with openings and extending over the containers, the at least one profile being arranged in the working space underneath the external line, the at least one profile distributing over the containers in the working space the sterile fluid introduced through the external line.

4. The device according to claim 3, each the at least one profile is rotatable around an axis between a first position, in which the at least one profile distributes the sterile fluid over the containers that are present in the working space, and a second position, in which the at least one profile allows cleaning fluid to enter the working space when no containers are present in the working space.

5. A method comprising:

introducing a sterile fluid from a sterile fluid supply into a working space, the fluid being delivered through an external line with several openings, the external line connected to the sterile fluid supply and extending through the working space;

conveying containers through the working space, and executing at least one work step on the containers in a sterile atmosphere in the working space; and introducing a cleaning medium from a cleaning medium supply through an internal line with several openings, the internal line passes through the external line, and spraying the cleaning medium into a space defined longitudinally between the internal and external lines, the internal line connected to the cleaning medium supply, which is different from the sterile fluid supply.

6. The method according to claim 5, wherein the cleaning medium is introduced through the internal line after the containers have been conveyed through the working space.

7. The method according to claim 5, wherein the internal line, designed as a pipe and the external line is designed as a pipe, the external and internal lines being rotated around longitudinal axes relative to each other at least for a predetermined length of time during the introduction of the cleaning medium through the internal line.

8. The method according to claim 5, wherein the sterile fluid is a gaseous sterile fluid that is introduced into the working space, and the cleaning medium is different from the sterile fluid.

9. The method according to claim 5, wherein the sterile fluid introduced through the external line is distributed over the containers in the working space by at least one profile with openings,

10. The method according to claim 9, wherein the cleaning medium is introduced through the internal line after the containers have been conveyed through the working space, and the at least one profile is rotated from a first position, in which containers are present in the working space, into a second position, in which the cleaning medium is applied, after the containers have been conveyed through the working space.

11. The device according to claim 1, wherein each of the external line and the internal line extends from one side of the working space to an opposite side of the working space.

* * * * *